US006725162B2

(12) United States Patent
Edwards et al.

(10) Patent No.: US 6,725,162 B2
(45) Date of Patent: Apr. 20, 2004

(54) METHOD FOR DETERMINING WELLBORE DIAMETER BY PROCESSING MULTIPLE SENSOR MEASUREMENTS

(75) Inventors: John E. Edwards, Feucherolles (FR); Luca Ortenzi, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/015,470

(22) Filed: Dec. 13, 2001

(65) Prior Publication Data

US 2003/0114987 A1 Jun. 19, 2003

(51) Int. Cl.[7] ..... G01V 1/40; G01V 3/18
(52) U.S. Cl. ..... 702/6; 324/338
(58) Field of Search ..... 702/6, 8; 175/50; 250/253; 324/338

(56) References Cited

U.S. PATENT DOCUMENTS

| | | | | |
|---|---|---|---|---|
| 5,469,736 A | * | 11/1995 | Moake | 73/152.58 |
| 5,486,695 A | | 1/1996 | Schultz et al. | |
| 5,699,246 A | * | 12/1997 | Plasek et al. | 702/11 |
| 5,900,733 A | * | 5/1999 | Wu et al. | 324/338 |
| 6,044,326 A | * | 3/2000 | Huiszoon | 702/8 |
| 6,049,757 A | * | 4/2000 | Sijercic et al. | 702/6 |
| 6,285,026 B1 | * | 9/2001 | Evans et al. | 250/269.4 |
| 6,384,605 B1 | * | 5/2002 | Li | 324/338 |

FOREIGN PATENT DOCUMENTS

| | | |
|---|---|---|
| EP | 0251696 A2 | 1/1988 |
| GB | 2252623 A | 8/1992 |
| GB | 2328746 A | 3/1999 |

OTHER PUBLICATIONS

Search Report Under Section 17 dated Apr. 4, 2003 for GB0226558.5.

* cited by examiner

*Primary Examiner*—John Barlow
*Assistant Examiner*—Toan M. Le
(74) *Attorney, Agent, or Firm*—Victor H. Segura; Brigitte L. Jeffery; John Ryberg

(57) ABSTRACT

A method is disclosed for producing a single logging-while-drilling (LWD) merged caliper from several indirect LWD borehole size measurements. The merging accounts for the varying validity of each input borehole size measurement as a function of the environment, the formation, and the borehole size itself. In one embodiment, the method includes obtaining a plurality of borehole size measurements from a plurality of LWD sensors and weighting each measurement with varying measurement confidence factors. One embodiment of the method includes determining a set of mathematical equations representative of the responses of the multiple sensors and solving the equation set to determine the borehole size. A computer encoded with instructions for weighting borehole size inputs and iteratively processing the weighted inputs to determine the merged caliper is also disclosed.

15 Claims, 3 Drawing Sheets

METHOD FOR DETERMINING WELLBORE DIAMETER BY PROCESSING MULTIPLE SENSOR MEASUREMENTS

BACKGROUND OF THE INVENTION

1. Field of the Invention

This invention relates generally to a method and apparatus for determining the size of a borehole and, more particularly, to techniques for processing borehole size measurements obtained with downhole sensors to determine the borehole diameter. The invention has general application in subsurface exploration and production, but is particularly useful in while-drilling operations.

2. Description of Related Art

In order to improve oil, gas, and water drilling and production operations, it is necessary to gather as much information as possible on the properties of the underground earth formations as well as the environment in which drilling takes place. Such properties include characteristics of the earth formations traversed by a well borehole and data on the size and configuration of the borehole itself. Among the characteristics of the earth formation of interest to drillers and petrophysicists is the resistivity of the rock or strata surrounding the borehole. However, the processes often employed to measure these characteristics are subject to significant errors unless information on the borehole size and configuration is also taken into account in their determination. Knowledge of the borehole size is also useful to estimate the hole volume, which, in turn, is used to estimate the volume of cement needed for setting casing or when hole stability is of concern during drilling.

The collection of downhole information, also referred to as logging, is realized in different ways. A well tool, comprising sources and sensors for measuring various parameters, can be lowered into the borehole on the end of a cable, or wireline. The cable, which is attached to some sort of mobile processing center at the surface, is the means by which parameter data is sent up to the surface. With this type of wireline logging, it becomes possible to measure borehole and formation parameters as a function of depth, i.e., while the tool is being pulled uphole.

An improvement over wireline logging techniques is the collection of data on downhole conditions during the drilling process. By collecting and processing such information during the drilling process, the driller can modify or correct key steps of the operation to optimize performance and avoid financial injury due to well damage such as collapse or fluid loss. Formation information collected during drilling also tends to be less affected by the drilling fluid ("drilling mud") invasion processes or other undesirable influences as a result of borehole penetration, and therefore are closer to the properties of the virgin formation.

Schemes for collecting data of downhole conditions and movement of the drilling assembly during the drilling operation are known as measurement-while-drilling (MWD) techniques. Similar techniques focusing more on measurement of formation parameters than on movement of the drilling assembly are know as logging-while-drilling (LWD). However, the terms MWD and LWD are often used interchangeably, and use of either term herein includes both the collection of formation and borehole information, as well as data on movement of the drilling assembly.

It is known in the art to measure the diameter, also known as the caliper, of a borehole to correct formation measurements that are sensitive to size or standoff. These corrections are necessary for accurate formation evaluation. U.S. Pat. No. 4,407,157 describes a technique for measuring a borehole caliper by incorporating a mechanical apparatus with extending contact arms that are forced against the sidewall of the borehole. This technique has practical limitations. In order to insert the apparatus in the borehole, the drillstring must be removed, resulting in additional cost and downtime for the driller. Such mechanical apparatus are also limited in the range of diameter measurement they provide.

Due to the unsuitability of mechanical calipers to drilling operations, indirect techniques of determining borehole calipers have been proposed for LWD measurements. Conventional LWD caliper measurement techniques include acoustic transducers that transmit ultrasonic signals for detection by appropriate sensors. U.S. Pat. Nos. 5,469,736 and 4,661,933 describe apparatus for measuring the caliper of a borehole by transmitting ultrasonic signals during drilling operations. U.S. Pat. No. 5,397,893 describes a method for analyzing formation data from a MWD tool incorporating an acoustic caliper. U.S. Pat. No. 5,886,303 describes a logging tool including an acoustic transmitter for obtaining the borehole caliper while drilling. U.S. Pat. No. 5,737,277 describes a method for determining the borehole geometry by processing data obtained by acoustic logging.

U.S. Pat. No. 4,899,112 describes a technique for determining a borehole caliper by computing phase differences and attenuation levels from electromagnetic measurements. U.S. Pat. No. 5,900,733 discloses a technique for determining borehole diameters by examining the phase shift, phase average, and attenuation of signals from multiple transmitter and receiver locations via electromagnetic wave propagation. GB 2187354 A and U.S. Pat. No. 5,519,668 also describe while-drilling methods for determining a borehole size using electromagnetic signals.

U.S. Pat. No. 5,091,644 describes a method for obtaining a borehole size measurement as a by-product of a rotational density measurement while drilling. U.S. Pat. No. 5,767,510 describes a borehole invariant porosity measurement that corrects for variations in borehole size. U.S. Pat. No. 4,916,400 describes a method for determining the borehole size as part of a while-drilling standoff measurement. U.S. Pat. No. 6,285,026 describes a LWD technique for determining the borehole diameter through neutron porosity measurements.

All of these subsurface measurement techniques are influenced by their immediate environment, and this influence has to be corrected to obtain an accurate measure of the undisturbed formation and borehole geometry. Thus it is desirable to obtain a simplified method for accurately determining the borehole shape and size. Still further, it is desired to implement a borehole size measurement technique that works for a wide range of borehole sizes and offers flexibility of measurement modes.

SUMMARY OF THE INVENTION

The invention provides a method for determining the size of a borehole penetrating an earth formation. The method comprises obtaining a plurality of borehole size measurements, each said measurement derived from one of a plurality of sensors that were disposed within said borehole; weighting each borehole size measurement with a factor associated with said measurement; and processing said weighted measurements to determine the borehole size.

The invention provides another method for determining the size of a borehole penetrating an earth formation. The method comprises obtaining a plurality of borehole size measurements derived from a plurality of sensors that were disposed within the borehole, said sensors being adapted to make said measurements using different measurement principals; determining a set of mathematical equations representative of the responses of said plurality of sensors; and solving said equation set to determine the borehole size.

The invention also provides a computer encoded with instructions for performing operations on a plurality of borehole size measurement inputs acquired with a plurality of sensors that were disposed within a borehole traversing a subsurface formation, the sensors being adapted to make said measurements using different measurement principals. The instructions comprise weighting each input with a factor associated with said measurement; and iteratively processing said weighted inputs to determine the size of said borehole.

BRIEF DESCRIPTION OF THE DRAWINGS

Other aspects and advantages of the invention will become apparent upon reading the following detailed description and upon reference to the drawings in which.

DETAILED DESCRIPTION

Figure 1:
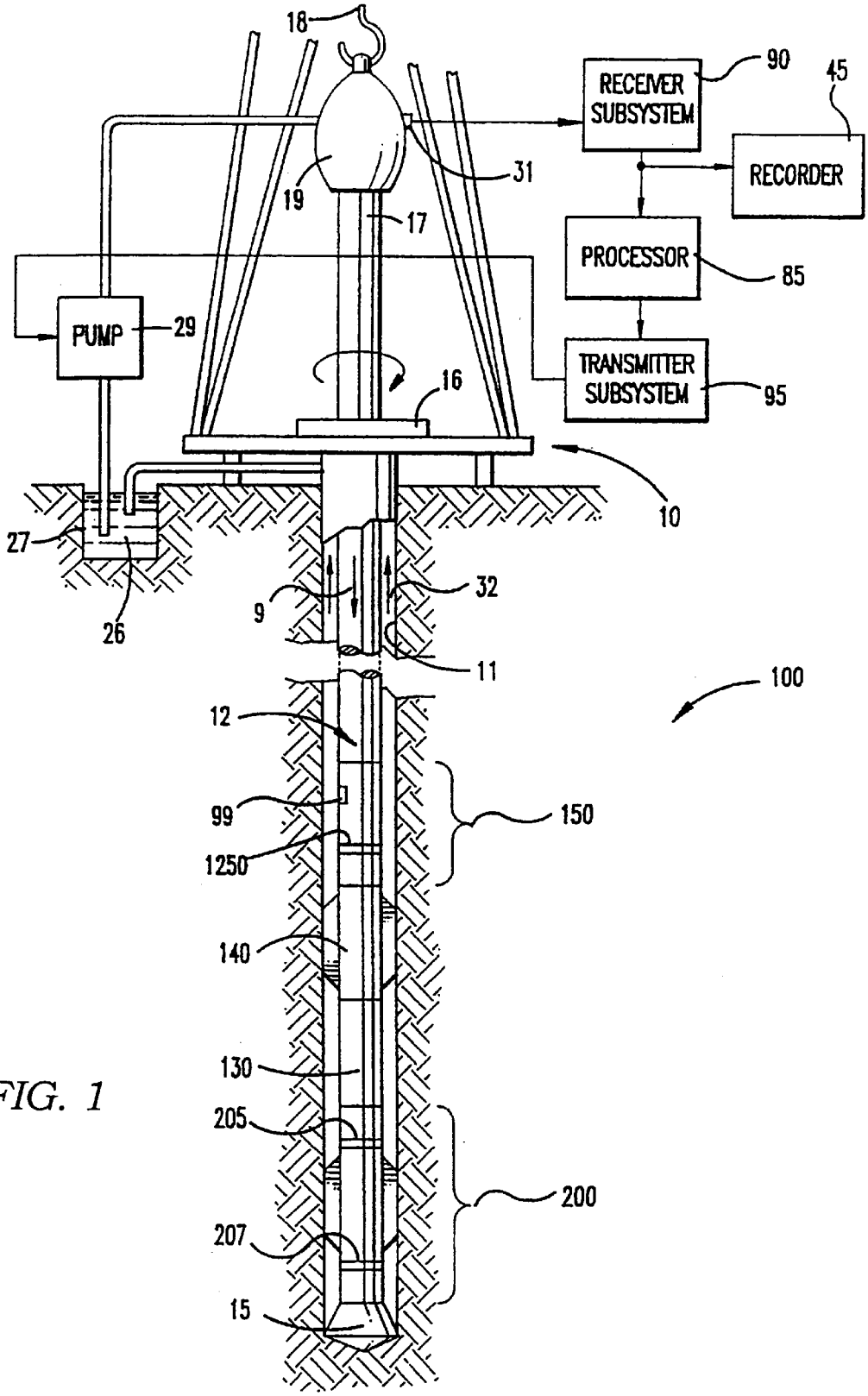
FIG. 1 shows a general view of a measurement while drilling system including one example of a logging while drilling (LWD) instrument.

A conventional LWD instrument and telemetry system is shown generally in FIG. 1. A drilling rig including a derrick 10 is positioned over a wellbore 11, which is drilled by a process known as rotary drilling. A drilling tool assembly (drill string) 12 and drill bit 15 coupled to the lower end of the drill string 12 are disposed in the wellbore 11. The drill string 12 and bit 15 are turned, by rotation of a kelly 17 coupled to the upper end of the drill string 12. The kelly 17 is rotated by engagement with a rotary table 16 or the like forming part of the rig 10. The kelly 17 and drill string 12 are suspended by a hook 18 coupled to the kelly 17 by a rotatable swivel 19. Alternatively, the kelly 17, swivel 19 and rotary table 16 can be substituted by a "top drive" or similar drilling rotator known in the art.

Drilling fluid ("drilling mud") is stored in a pit 27 or other type of tank, and is pumped through the center of the drill string 12 by a mud pump 29, to flow downwardly (shown by arrow 9) therethrough. After circulation through the bit 15, the drilling fluid circulates upwardly (indicated by arrow 32) through an annular space between the wellbore 11 and the outside of the drill string 12. Flow of the drilling mud lubricates and cools the bit 15 and lifts drill cuttings made by the bit 15 to the surface for collection and disposal.

A bottom hole assembly (BHA), shown generally at 100 is connected within the drill string 12. The BHA 100 includes in this example a stabilizer 140 and drill collar 130 that mechanically connect a local measuring and local communications device 200 to the BHA 100. In this example, the BHA 100 includes a toroidal antenna 1250 for electromagnetic communication with the local measuring device 200, although it should be understood that other communication links between the BHA 100 and the local device 200 could be used as known in the art. The BHA 100 includes a communications system 150, which provides a pressure modulation telemetry transmitter and receiver therein. Pressure modulation telemetry can include various techniques for selectively modulating the flow (and consequently the pressure) of the drilling mud flowing downwardly 9 through the drill string 12 and BHA 100. One such modulation technique is known as phase shift keying of a standing wave created by a "siren" (not shown) in the communications system 150. A transducer 31 disposed at the earth's surface, generally in the fluid pump discharge line, detects the pressure variations generated by the siren (not shown) and conducts a signal to a receiver decoder system 90 for demodulation and interpretation. The demodulated signals can be coupled to a processor 85 and recorder 45 for further processing. Optionally, the surface equipment can include a transmitter subsystem 95 which includes a pressure modulation transmitter (not shown separately) that can modulate the pressure of the drilling mud circulating downwardly 9 to communicate control signals to the BHA 100.

The communications subsystem 150 may also include various types of processors and controllers (not shown separately) for controlling operation of the various sensors disposed therein, and for communicating command signals to the local device 200 and receiving and processing measurements transmitted from sensors disposed on the local device 200. Sensors in the BHA 100 and/or communications system 150 can also include, among others, magnetometers and accelerometers (not shown separately in FIG. 1). As is well known in the art, the output of the magnetometers and accelerometers can be used to determine the rotary orientation of the BHA 100 with respect to earth's gravity as well as a geographic reference such as magnetic and/or geographic north. The output of the accelerometers and magnetometers (not shown) can also be used to determine the trajectory of the wellbore 11 with respect to these same references (or another selected reference), as is well known in the art. The BHA 100 and/or the communications system 150 can include various forms of data storage or memory which can store measurements made by any or all of the sensors, including sensors disposed in the local device 200, for later processing as the drill string 12 is withdrawn from the wellbore 11.

Conventional LWD measurements have enough redundancy to self-correct for errors caused by the immediate environment. The magnitude of this self-correction is related to the borehole size, however this relationship to borehole size is strong or weak depending on the borehole size itself, and other environmental and formation related variables.

Generally speaking, the invention discloses a process for producing a single LWD merged caliper from the several indirect LWD borehole size measurements. This merging process accounts for the varying validity of each input borehole size measurement as a function of the environment, the formation, and the borehole size itself by weighting level by level each input with varying measurement confidence factors.

Each input borehole size measurement has its own measurement confidence factor algorithm. This algorithm depends on the measurement principal, and environmental and formation parameters. These environmental and formation parameters can be either LWD measurements, or input parameters. In the event the measurement confidence factors of the borehole size measurements are similar, a set of spatial resolution factors may be used to weight the merged caliper towards the input with the highest resolution.

The invention is implemented by inverting a collection of signals or measurement data using model-dependent weightings. Suppose that we are given a collection of sensors, such as those used in conventional measurement tools, which are dependent upon formation parameters $f=\{f_1,f_2,\ldots\}$ as well as the borehole diameter b. Let $T_s(f,\beta)$ be a modeling value of the sensor $T_s$ as a function of these formation variables and boreholes, then we define a solution as $$b = \min_{\beta} \sum_{s \in S} \omega_s(b) \min_{f} \left\| \int \hat{T}_s - \int T_s(f, \beta) \right\|, \tag{1}$$

where $\omega_s(b)$ is the weighting for the sth sensor in a borehole b. The $\| \|$ indicate an appropriate norm, such as the least-squares norm.

The above equation can be solved iteratively for b. Those skilled in the art will appreciate that both standard and state-of-the-art methods can be used to compute, or estimate, $\omega_s(b)$. For example, if we have a good understanding of the noise in $T_s(f, \beta)$ as a function of $\beta$ we can use this to replace $\omega_s(b)$ with a function of that noise estimate, which we write as $\hat{\omega}_s(\beta)$. This is a standard process in the Kalman filter algorithm. In this case, the caliper estimate is $$b = \min_{\beta} \sum_{s \in S} \hat{\omega}_s(\beta) \min_{f} \left\| \int \hat{T}_s - \int T_s(f, \beta) \right\|. \tag{2}$$

An advantage of this expression is that the weighting terms used for the minimization do not depend upon the solution of that minimization. The weighting factors may change as a function of the borehole environment, as well as a function of the measurement itself. For example if the drilling mud is oil-based, or low salinity water-based, certain types of resistivity measurements could have a different weighting, The domain of integration can also be optimized to speed up the search. One possibility would be to restrict the domain to a level-by-level approach with the data from multiple BHA positions resampled so that the sensors have a common depth point. One could then make the assumption that the caliper was essentially the same over the interval that the BHA passed. Alternatively, another embodiment of the invention could be implemented with a scheme so that, say, the borehole size could only get bigger over the time interval that the BHA passed the level. Another embodiment could also be coded to minimize simultaneously for borehole caliper and mud-properties such as resistivity or density.

It will be apparent to those of ordinary skill having the benefit of this disclosure that the present invention may be implemented by programming one or more suitable general-purpose computers having appropriate hardware. The programming may be accomplished through the use of one or more program storage devices readable by the computer processor and encoding one or more programs of instructions executable by the computer for performing the operations described above. The program storage device may take the form of, e.g., one or more floppy disks; a CD ROM or other optical disk; a magnetic tape; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here.

Figure 2:
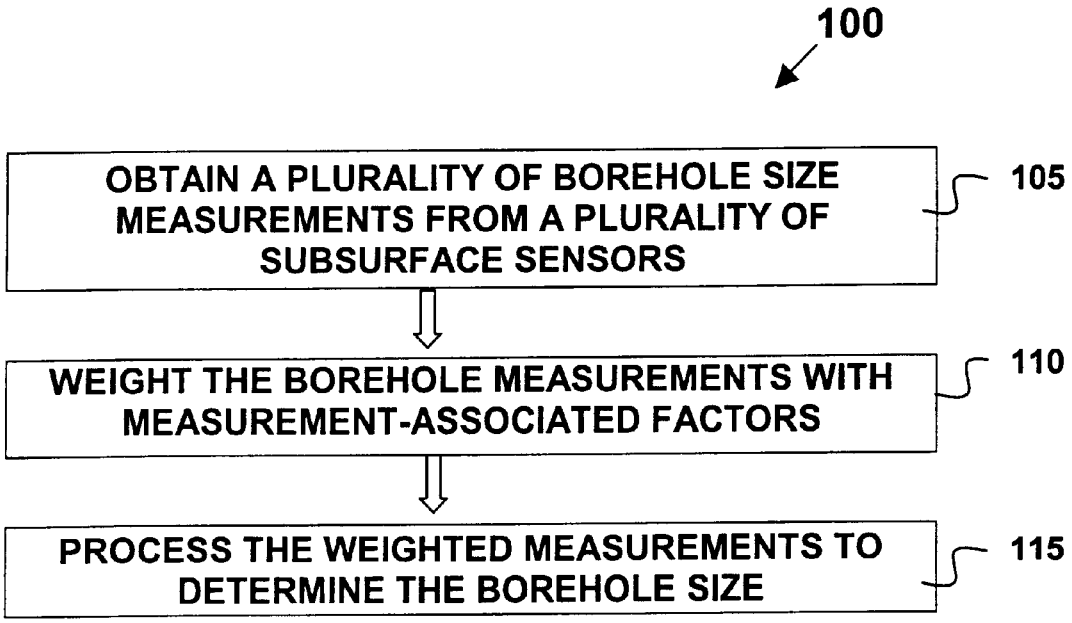
FIG. 2 is a flow chart of one example of a process for determining the size of a borehole penetrating an earth formation according to the invention.

FIG. 2 illustrates a flow diagram of a method 100 for determining the size of a borehole penetrating an earth formation. The method comprises obtaining a plurality of borehole size measurements, each said measurement derived from one of a plurality of sensors that were disposed within said borehole 105; weighting each borehole size measurement with a factor associated with said measurement 110; and processing said weighted measurements to determine the borehole size 115.

Figure 3:
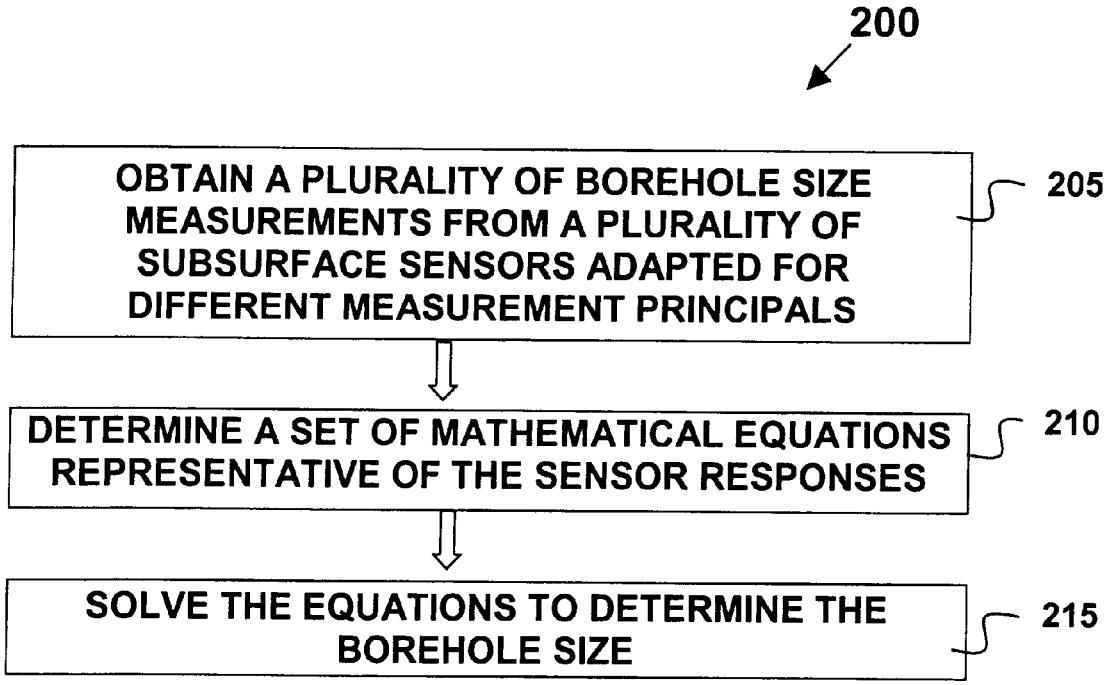
FIG. 3 is another flow chart of another process for determining the size of a borehole penetrating an earth formation according to the invention.

FIG. 3 illustrates a flow diagram of another method 200 for determining the size of a borehole penetrating an earth formation. The method comprises obtaining a plurality of borehole size measurements derived from a plurality of sensors that were disposed within the borehole, said sensors being adapted to make said measurements using different measurement principals 205; determining a set of mathematical equations representative of the responses of said plurality of sensors 210; and solving said equation set to determine the borehole size 215.

The invention is not limited to using subsurface measurements made by the particular instruments or sensors described in any of the foregoing patents. It should be clearly understood that the invention is usable with borehole and formation measurements acquired with any suitable sensor adapted to detect subsurface signals. It will also be apparent to those skilled in the art that a number of techniques which do not depart from the concept and scope of the invention may be used to invert a collection of signals using model-dependent weightings to determine the borehole diameter. All such similar variations apparent to those skilled in the art are deemed to be within the scope of the invention as defined by the appended claims.

What is claimed is:

1. A method for determining the size of a borehole penetrating an earth formation, comprising:

(a) obtaining a plurality of borehole size b measurements, each said measurement derived from one of a plurality of sensors that were disposed within said borehole;

(b) weighting each borehole size measurement with a factor associated with said measurement, wherein the weighting yields the borehole size measurement with the highest resolution when said weightings are similar; and (c) iteratively processing said weighted measurements to determine the borehole size according to $$b = \min_{\beta} \sum_{s \in S} \omega_s(b) \min_{f} \left\| \int \hat{T}_s - \int T_s(f, \beta) \right\|$$

where, $T_s(f, \beta)$ is a theoretical response of sensor $T_s$;

$\omega_s$ (b) is a weighting for the sth sensor in a borehole; and $\| \|$ indicates a norm.

2. The method of claim 1, wherein each sensor of the plurality of sensors uses a different measurement principle to make the borehole size measurement.

3. The method of claim 2, wherein at least one factor of step (b) includes environmental, formation, or measurement principle parameters.

4. The method of claim 2, wherein step (b) includes using a theoretical response of one of said sensors to derive at least one of said factors.

5. The method of claim 2, wherein at least one of said plurality of borehole size measurements is derived from a sensor that was disposed within the borehole while drilling said borehole.

6. The method of claim 2, wherein said plurality of sensors includes a sensor adapted to detect one of an acoustic, neutron, gamma, or electromagnetic signal.

7. A method for determining the size of a borehole penetrating an earth formation, comprising:

(a) obtaining a plurality of borehole size b measurements derived from a plurality of sensors that were disposed within the borehole, said sensors being adapted to make said measurements using different measurement principles;

(b) determining a set of mathematical equations representative of the responses of said plurality of sensors, the equations including weightings associated with the borehole size measurement, wherein the weightings yield the borehole size measurement with the highest resolution when said weightings are similar; and (c) performing an iterative technique to solve said equation set to determine the borehole size according to $$b = \min_{\beta} \sum_{s \in S} \omega_s(b) \min_{f} \left\| \int \hat{T}_s - \int T_s(f, \beta) \right\|$$

where, $T_s(f, \beta)$ is a theoretical response of sensor $T_s$;

$\omega_s$ (b) is a weighting for the sth sensor in a borehole; and $\| \|$ indicates a norm.

8. The method of claim 7, wherein at least one of said plurality of borehole size measurements is derived from a sensor that was disposed within the borehole while drilling said borehole.

9. The method of claim 7, wherein the equations of step (b) include variables associated with environmental, formation, or measurement principle parameters.

10. The method of claim 7, wherein said plurality of sensors includes a sensor adapted to detect one of an acoustic, neutron, gamma, or electromagnetic signal.

11. A computer encoded with instructions for performing operations on a plurality of borehole size b measurement inputs acquired with a plurality of sensors that were disposed within a borehole traversing a subsurface formation, the sensors being adapted to make said measurements using different measurement principles, said instructions comprising:

weighting each input with a factor associated with said measurement, wherein the weighting yields the borehole size measurement with the highest resolution when said weightings are similar; and iteratively processing said weighted inputs to determine the size of said borehole according to $$b = \min_{\beta} \sum_{s \in S} \omega_s(b) \min_{f} \left\| \int \hat{T}_s - \int T_s(f, \beta) \right\|$$

where, $T_s(f, \beta)$ is a theoretical response of sensor $T_s$;

$\omega_s(b)$ is a weighting for the sth sensor in a borehole; and $\| \|$ indicates a norm.

12. The computer of claim 11, wherein said weighting factors are associated with environmental, formation, or measurement principle parameters.

13. The computer of claim 11, wherein said input weighting includes using a theoretical response of one of said sensors to derive at least one of said factors.

14. The computer of claim 11, wherein at least one of said measurement inputs represents a borehole size measurement derived from a sensor that was disposed within said borehole while drilling said borehole.

15. The computer of claim 11, wherein said plurality of sensors includes a sensor adapted to detect one of an acoustic, neutron, gamma, or electromagnetic signal.

* * * * *